US006100808A

United States Patent [19]

Lin

[11] Patent Number: 6,100,808

[45] Date of Patent: Aug. 8, 2000

[54] BREAK DISPLAY LAMP OF A SOCKET

[76] Inventor: Wen-Jang Lin, 58, Ma Yuan West St., Taichung, Taiwan

[21] Appl. No.: 09/422,220

[22] Filed: Oct. 21, 1999

[51] Int. Cl.[7] ..... G08B 21/00

[52] U.S. Cl. ..... 340/638; 337/376; 337/380

[58] Field of Search ..... 340/638, 693.9; 337/112, 376, 380; 361/115

[56] References Cited

U.S. PATENT DOCUMENTS 3,984,765 10/1976 Rocci, Jr. .
4,000,444 12/1976 Douglas et al. .
4,691,197 9/1987 Damiano et al. ..... 340/638
5,701,118 12/1997 Hull et al. ..... 340/638
5,939,991 8/1999 Deng ..... 340/638
5,986,557 11/1999 Clarke ..... 340/638

*Primary Examiner*—Julie Lieu

[57] ABSTRACT

A socket has a hollow base casing, and an upper casing engaging with the hollow base casing. The upper casing has an oblong hole and a pair of slots. The hollow base casing receives a first conductive blade, a second conductive blade, a fixed plate, and a metal bar. A breaker device is disposed between the upper casing and the hollow base casing. A metal bar contacts the first conductive blade. The metal bar will be bent while a current is overloading. Then the metal bar will not contact the first conductive blade. A break display lamp and a resistor are disposed in the upper casing. The break display lamp is connected to the resistor.

2 Claims, 7 Drawing Sheets

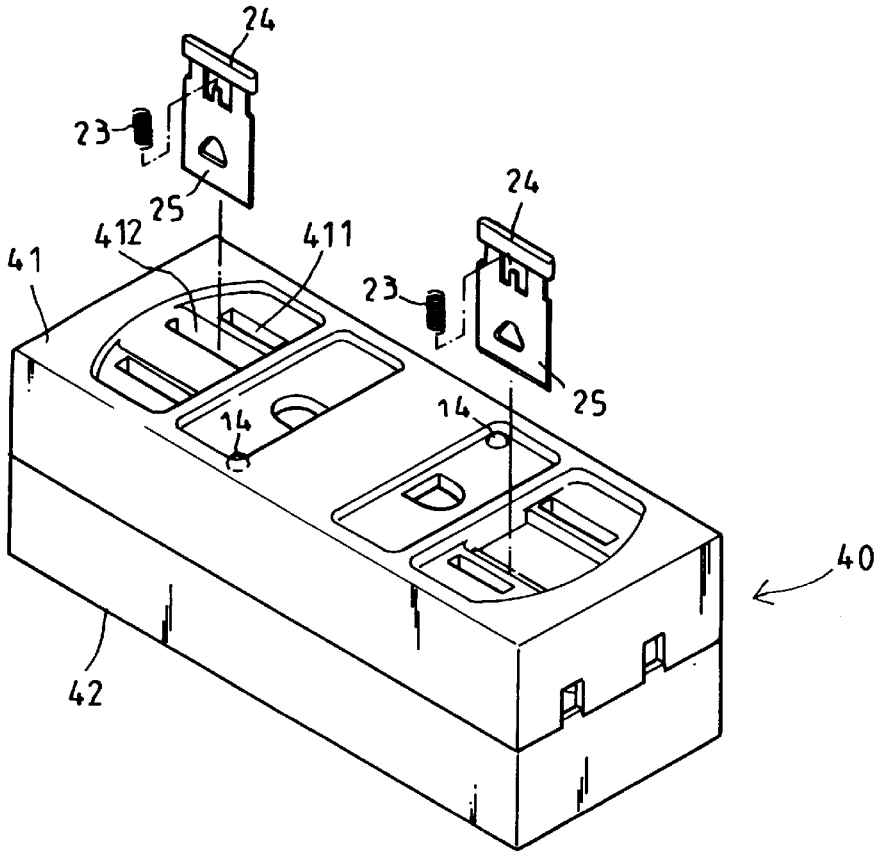
FIG: 2
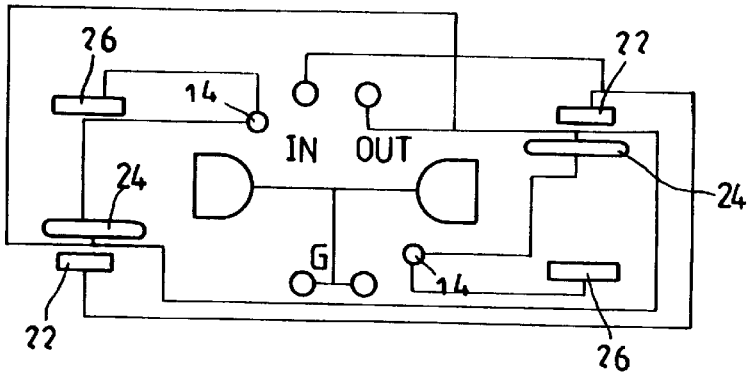
FIG: 2-A

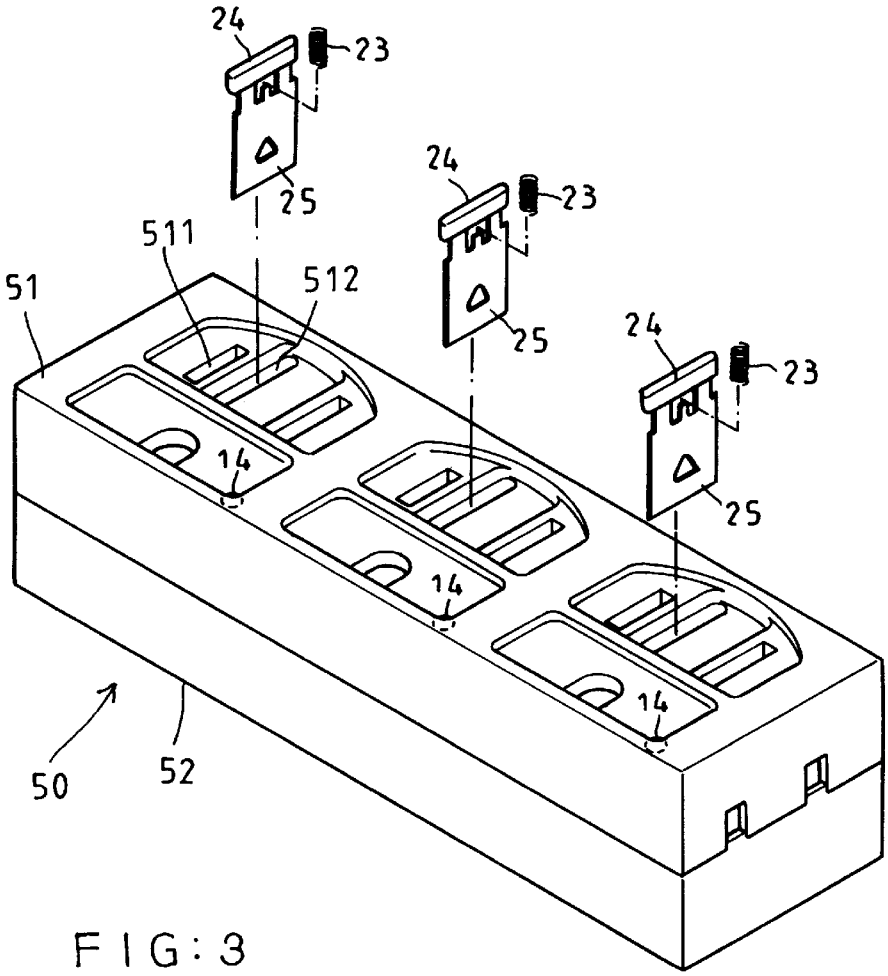
FIG: 3
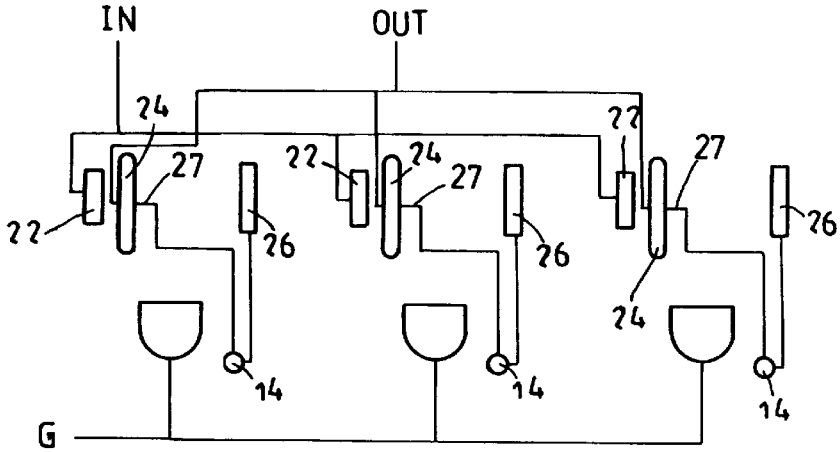
FIG: 3-A

BREAK DISPLAY LAMP OF A SOCKET

BACKGROUND OF THE INVENTION

The present invention relates to a lamp assembly which is disposed in a socket. More particularly, the present invention relates to a lamp assembly which has at least a break display lamp.

A conventional breaker device is often disposed in a conventional socket. However, the conventional socket does not have a break display lamp to show a current overloading.

SUMMARY OF THE INVENTION

An object of the present invention is to provide a break display lamp which is disposed in a socket to be discontinued while overloading.

In accordance with a first preferred embodiment of the present invention, a socket comprises a hollow base casing, and an upper casing engaging with the hollow base casing. The upper casing comprises an oblong hole and a pair of slots. The hollow base casing receives a first conductive blade, a second conductive blade, a fixed plate, and a metal bar. A conventional fuseless breaker device is disposed between the upper casing and the hollow base casing. The breaker device comprises the metal bar having two expansion coefficients, an insulator plate disposed in the oblong hole of the upper casing, a safety button disposed on a top end of the insulator plate, and a coiled spring disposed on an upper portion of the insulator plate. The metal bar contacts the first conductive blade. The metal bar will be bent while a current is overloading. Then the metal bar will not contact the first conductive blade. A break display lamp and a resistor are disposed in the upper casing. The break display lamp is connected to the resistor. The resistor is connected to the second conductive blade. The break display lamp is connected to the fixed plate. The fixed plate contacts the metal bar.

In accordance with a second preferred embodiment of the present invention, a socket comprises a hollow base casing, and an upper casing engaging with the hollow base casing. The upper casing comprises an oblong hole and a pair of slots. The hollow base casing receives a first conductive blade, a second conductive blade, a fixed plate, and a metal bar. A conventional fuseless breaker device is disposed between the upper casing and the hollow base casing. The breaker device comprises the metal bar having two expansion coefficients, an insulator plate disposed in the oblong hole of the upper casing, a safety button disposed on a top end of the insulator plate, and a coiled spring disposed on an upper portion of the insulator plate. The metal bar contacts the first conductive blade. The metal bar will be bent while a current is overloading. Then the metal bar will not contact the first conductive blade. A break display lamp and a resistor are disposed in the upper casing. The break display lamp is connected to the resistor. The resistor is connected to the second conductive blade. The break display lamp is connected to the first conductive blade. The fixed plate contacts the metal bar.

BRIEF DESCRIPTION OF THE DRAWINGS

FIG. 2 is a perspective exploded view of a socket of a second preferred embodiment in accordance with the present invention;

FIG. 2A is an electrical schematic view illustrating an electric circuit of a second preferred embodiment in accordance with the present invention;

FIG. 3 is a perspective exploded view of a socket of a third preferred embodiment in accordance with the present invention;

FIG. 3A is an electrical schematic view illustrating an electric circuit of a third preferred embodiment in accordance with the present invention;

DETAILED DESCRIPTION OF THE INVENTION

Figure 1:
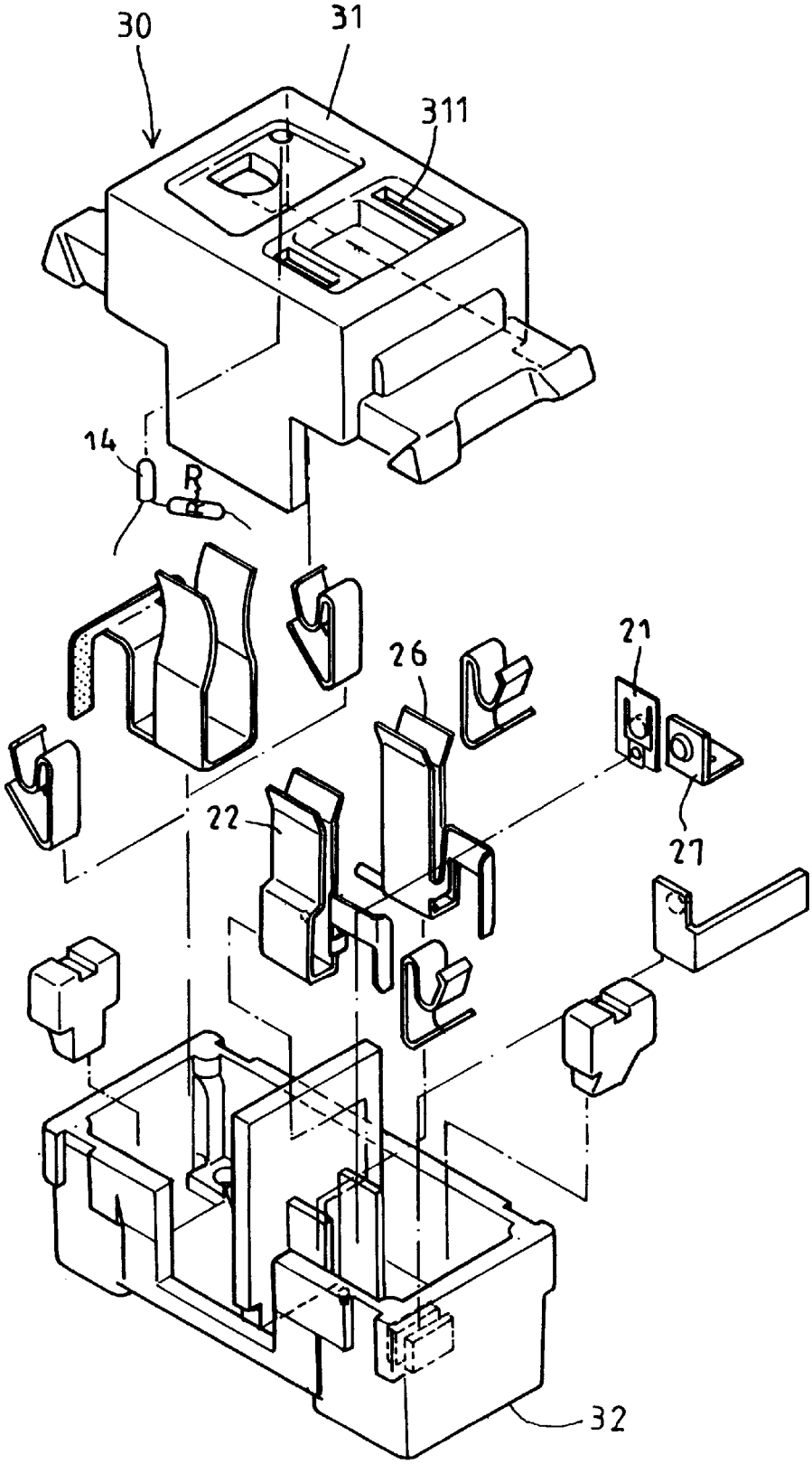
FIG. 1 is a perspective exploded view of a socket of a first preferred embodiment in accordance with the present invention.
Figure 1A:
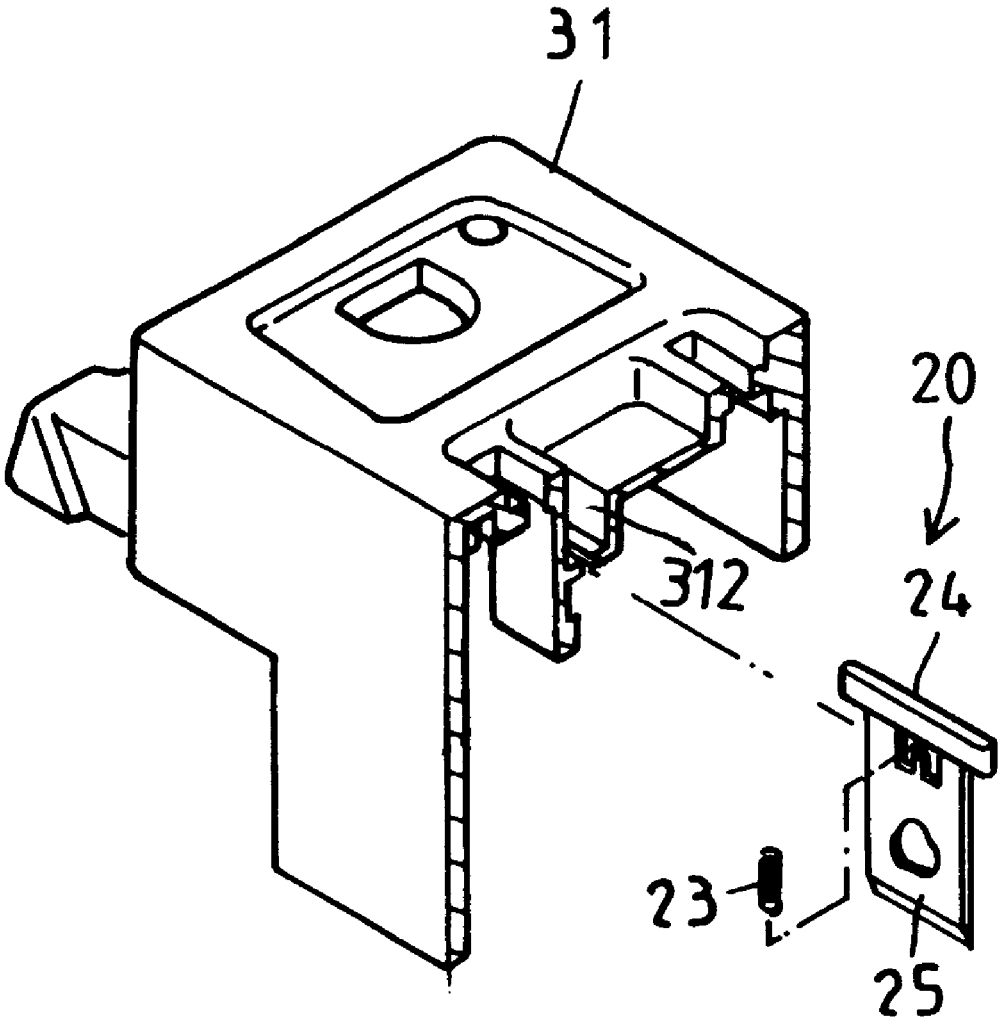
FIG. 1A is a partially perspective exploded view of an upper casing and a breaker device of a first preferred embodiment in accordance with the present invention.
Figure 4A:
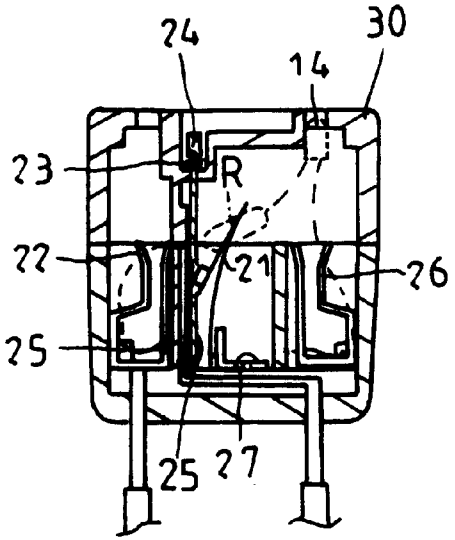
FIG. 4A is a sectional assembly view of a socket of a first preferred embodiment in accordance with the present invention.
Figure 4:
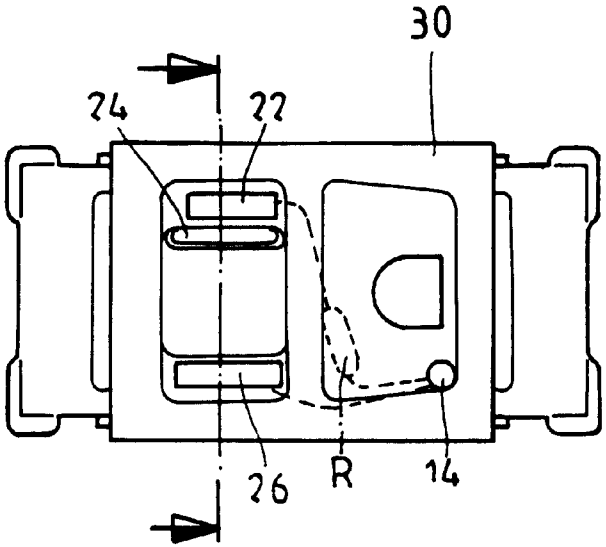
FIG. 4 is an elevational view of a socket of a first preferred embodiment in accordance with the present invention.

Referring to FIGS. 1, 1A, 4 and 4A, a first socket 30 comprises a hollow base casing 32, and an upper casing 31 engaging with the hollow base casing 32.

The upper casing 31 comprises an oblong hole 312 and a pair of slots 311.

The hollow base casing 32 receives a first conductive blade 22, a second conductive blade 26, a fixed plate 27, and a metal bar 21.

A conventional fuseless breaker device 20 is disposed between the upper casing 31 and the hollow base casing 32. The breaker device 20 comprises the metal bar 21 having two expansion coefficients, an insulator plate 25 disposed in the oblong hole 312 of the upper casing 31, a safety button 24 disposed on a top end of the insulator plate 25, and a coiled spring 23 disposed on an upper portion of the insulator plate 25.

The metal bar 21 contacts the first conductive blade 22. The metal bar 21 will be bent while a current is overloading. Then the metal bar 21 will not contact the first conductive blade 22.

A break display lamp 14 and a resistor R are disposed in the upper casing 31. The break display lamp 14 is connected to the resistor R.

Figure 7:
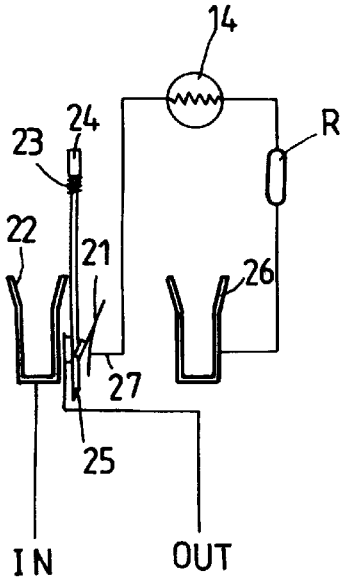
FIG. 7 is an electrical schematic view illustrating an electric circuit for a break display lamp arranged in parallel.

Referring to FIG. 7, the resistor R is connected to the second conductive blade 26. The break display lamp 14 is connected to the fixed plate 27. The fixed plate 27 contacts the metal bar 21.

When the current is overloading, the metal bar 21 will not contact the first conductive blade 22 and the safety button 24 will be ejected upward. Then the insulator plate 25 will separate the metal bar 21 and the first conductive blade 22. The break display lamp 14 will be discontinued.

Figure 8:
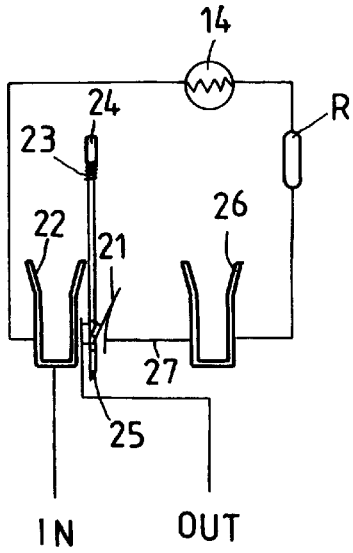
FIG. 8 is an electrical schematic view illustrating an electric circuit for a break display lamp arranged in series.

Referring to FIG. 8, the resistor R is connected to the second conductive blade 26. The break display lamp 14 is connected to the first conductive blade 22. The fixed plate 27 contacts the metal bar 21.

The metal bar 21 will be bent and the safety button 24 will be ejected while a current is overloading. The break display lamp 14 will be discontinued.

Figure 5:
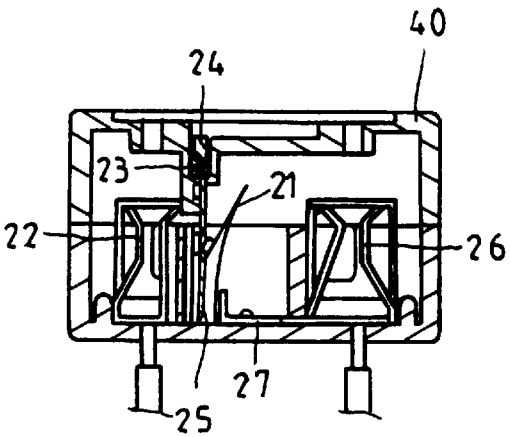
FIG. 5 is a sectional assembly view of a socket of a second preferred embodiment in accordance with the present invention.

Referring to FIGS. 2, 2A and 5, a second socket 40 comprises a hollow base casing 42, and an upper casing 41 engaging with the hollow base casing 42.

The upper casing 41 comprises two oblong holes 412 and two pairs of slots 411.

The hollow base casing 42 receives two first conductive blades 22, two second conductive blades 26, and two fixed plates 27.

Two conventional fuseless breaker devices are disposed between the upper casing 41 and the hollow base casing 42. Each of the breaker devices 20 comprises a metal bar 21 having two expansion coefficients, an insulator plate 25 disposed in one of the oblong holes 412 of the upper casing 41, a safety button 24 disposed on a top end of the insulator plate 25, and a coiled spring 23 disposed on an upper portion of the insulator plate 25.

Each of the metal bars 21 contacts one of the first conductive blades 22. The metal bar 21 will be bent while a current is overloading. Then the metal bar 21 will not contact the first conductive blade 22. Two break display lamps 14 are disposed in the upper casing 41.

Figure 6:
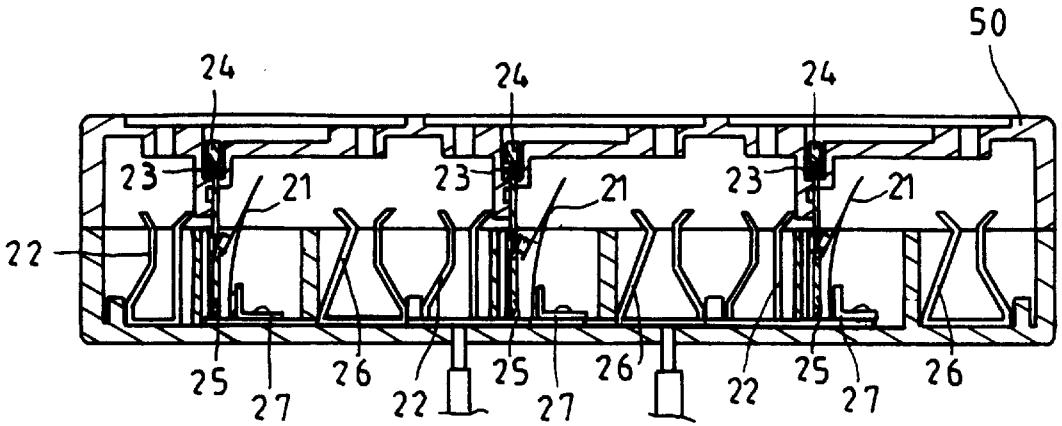
FIG. 6 is a sectional assembly view of a socket of a third preferred embodiment in accordance with the present invention.

Referring to FIGS. 3, 3A and 6, a third socket 50 comprises a hollow base casing 52, and an upper casing 51 engaging with the hollow base casing 52.

The upper casing 51 comprises three oblong holes 512 and three pairs of slots 511. The hollow base casing 52 receives three first conductive blades 22, three second conductive blades 26, and three fixed plates 27.

Three conventional fuseless breaker devices are disposed between the upper casing 51 and the hollow base casing 52. Each of the breaker devices 20 comprises a metal bar 21 having two expansion coefficients, an insulator plate 25 disposed in one of the oblong holes 512 of the upper casing 51, a safety button 24 disposed on a top end of the insulator plate 25, and a coiled spring 23 disposed on an upper portion of the insulator plate 25.

Each of the metal bars 21 contacts one of the first conductive blades 22. The metal bar 21 will be bent while a current is overloading. Then the metal bar 21 will not contact the first conductive blade 22. Three break display lamps 14 are disposed in the upper casing 51.

The present invention is not limited to the above embodiments but various modification thereof may be made. Furthermore, various changes in form and detail may be made without departing from the scope of the present invention.

I claim:

1. A socket comprises:

a hollow base casing, and an upper casing engaging with the hollow base casing, the upper casing comprising an oblong hole and a pair of slots, the hollow base casing receiving a first conductive blade, a second conductive blade, a fixed plate, and a metal bar, a conventional fuseless breaker device disposed between the upper casing and the hollow base casing, the breaker device comprising the metal bar having two expansion coefficients, an insulator plate disposed in the oblong hole of the upper casing, a safety button disposed on a top end of the insulator plate, and a coiled spring disposed on an upper portion of the insulator plate, a break display lamp and a resistor disposed in the upper casing, the break display lamp connected to the resistor, the resistor connected to the second conductive blade, the break display lamp connected to the fixed plate, the fixed plate contacting the metal bar, the metal bar contacting the first conductive blade, when a current is overloading, the metal bar will be bent and the metal bar will not contact the first conductive blade.

2. A socket comprises:

a hollow base casing, and an upper casing engaging with the hollow base casing, the upper casing comprising an oblong hole and a pair of slots, the hollow base casing receiving a first conductive blade, a second conductive blade, a fixed plate, and a metal bar, a conventional fuseless breaker device disposed between the upper casing and the hollow base casing, the breaker device comprising the metal bar having two expansion coefficients, an insulator plate disposed in the oblong hole of the upper casing, a safety button disposed on a top end of the insulator plate, and a coiled spring disposed on an upper portion of the insulator plate, a break display lamp and a resistor disposed in the upper casing, the break display lamp connected to the resistor, the resistor connected to the second conductive blade, the break display lamp connected to the first conductive blade, the fixed plate contacting the metal bar, the metal bar contacting the first conductive blade, when a current is overloading, the metal bar will be bent and the metal bar will not contact the first conductive blade.

* * * * *